US005994797A

United States Patent [19]

Yamaoka

[11] Patent Number: 5,994,797

[45] Date of Patent: Nov. 30, 1999

[54] DRIVE CIRCUIT SYSTEM FOR POWER WINDOW

[75] Inventor: Koji Yamaoka, Wako, Japan

[73] Assignee: Honda Giken Kogyo Kabushiki Kaisha, Tokyo, Japan

[21] Appl. No.: 09/130,447

[22] Filed: Aug. 6, 1998

[30] Foreign Application Priority Data

Aug. 8, 1997 [JP] Japan ..... 9-214935

[51] Int. Cl.[6] ..... H01H 47/00

[52] U.S. Cl. ..... 307/125; 307/113; 307/115; 307/116

[58] Field of Search ..... 307/9.1, 10.1, 307/113, 115, 116, 125, 119, 139, 140, 143; 318/3, 9, 10, 135, 218; 361/30, 31, 33, 42, 79, 88

[56] References Cited

U.S. PATENT DOCUMENTS

| | | | |
|---|---|---|---|
| 4,246,575 | 1/1981 | Purtell et al. | 340/605 |
| 4,394,605 | 7/1983 | Terazawa | 318/280 |
| 4,761,593 | 8/1988 | Nakase | 318/473 |
| 4,942,612 | 7/1990 | Wu | 361/49 |
| 5,097,186 | 3/1992 | Kokubu | 318/280 |
| 5,128,597 | 7/1992 | Kokubu | 318/286 |
| 5,329,163 | 7/1994 | Satoh et al. | 307/10.1 |
| 5,627,411 | 5/1997 | Bochenek | 307/10.1 |
| 5,698,907 | 12/1997 | Weber | 307/9.1 |

*Primary Examiner*—Albert W. Paladini
*Assistant Examiner*—Peter Zura
*Attorney, Agent, or Firm*—Nikaido, Marmelstein, Murray & Oram, LLP

[57] ABSTRACT

A circuit is provided to ensure that even when a drive circuit system for a power window is wetted with water due to the entering of water or the condensatin of water, the opening and closing of the power window can be performed without hindrance. Coils of an opening relay and a closing relay are selectively connected at one end thereof to a power source or ground through a control switch and at the other end to the power source or ground through an electronic circuit which has been subjected to a water-proofing treatment. Even if leakage current flows from a high-potential portion of the coils to ground, the leakage current is caught by electric current flowing from the power source. In addition, even if leakage current flows from the power source to a lower-potential portion of the coils, the leakage current flows to ground without passing through the coils. Therefore, the unintended excitation and de-excitation of the coils can be prevented to thereby reliably open and close the power window.

2 Claims, 7 Drawing Sheets

WHEN POWER WINDOW IS DRIVEN BY ELECTRONIC CIRCUIT

DRIVE CIRCUIT SYSTEM FOR POWER WINDOW

BACKGROUND OF THE INVENTION

1. Field of the Invention

The present invention relates to a drive circuit system for a power window, for driving a motor to open and close the power window.

2. Description of the Prior Art

FIG. 7 shows a prior art drive circuit for a power window. A three-position control switch S operated by an occupant, an opening relay Ro adapted to be turned ON for opening the power window and a closing relay Rs adapted to be turned ON for closing the power window, are connected between a first line $L_1$ connected to a power source 1 comprising a battery of 12 volts mounted on a vehicle and a second line $L_2$ connected to a ground 2 of 0 volts. The control switch S includes a contact 3 biased toward a neutral position by a spring which is not shown. The contact 3 is capable of being connected to an opening terminal 4*o* or a closing terminal 4*s* by an occupant's operation. When the control switch S is operated from a neutral position as shown to an opening position to connect the contact 3 to the opening terminal 4*o*, a coil 5*o* of the opening relay Ro is excited, whereby a contact 6*o* is separated from an OFF terminal 7*o* and connected to an ON terminal 8*o*. As a result, a circuit of the power source 1 to the first line $L_1$ to the ON terminal 8*o* of the opening relay Ro and the contact 6*o* to a third line $L_3$ to a motor 9 to the third line $L_3$ to a contact 6*s* of the closing relay Rs and an OFF terminal 7*s* to the second line $L_2$ to ground 2, is formed, whereby the motor 9 is driven in an opening direction to open the power window.

When the control switch S is operated from the neutral position as shown to the closing position to connect the contact 3 to the closing terminal 4*s*, a coil 5*s* of the closing relay Rs is excited, whereby the contact 6*s* is separated from the OFF terminal 7*s* and connected to an ON terminal 8*s*. As a result, a circuit of the power source 1 K the first line $L_1$ K the ON terminal 8*s* of the closing relay Rs and the contact 6*s* K the third line $L_3$ K the motor 9 K the third line $L_3$ K the contact 6*o* of the opening relay Ro and the OFF terminal 7*o* K the second line $L_2$ K ground 2, is formed, whereby the motor 9 is driven in a closing direction to close the power window.

The opening relay Ro and the closing relay Rs are also capable of being controlled by an electronic circuit E. More specifically, when an opening transistor 9*o* of the electronic circuit E is turned ON, the coil 5*o* is connected to ground 2 without going through the control switch S, to close the opening relay Ro. When a closing transistor 9*s* of the electronic circuit E is turned ON, the coil 5*s* is connected to ground 2 without going through the control switch S, to close the closing relay Rs. Therefore, the power window can be opened and closed.

When the control switch S of the drive circuit system for the power window is wet with water due to the entering of water or the condensation of water, if leakage current Ao flows from the opening terminal 4*o* to the contact 3, the coil 5*o* is excited, thereby causing the power window to be opened. If leakage current As flows from the closing terminal 4*s* to the contact 3, the coil 5*s* is excited, thereby causing the power window to be closed. If the leakage currents Ao and As flow simultaneously, opposite ends of the motor 9 are brought into a higher potential, so that the motor 9 cannot be rotated, whereby it is impossible to open or close the power window. A problem also arises, when leakage currents Bo and Bs flow from the coils 5*o*, 5*s* to the ground 2. In addition, even if the electronic circuit E is subjected to a water-proofing treatment to prevent the mis-operation of the opening transistor 9*o* and the closing transistor 9*s*, a problem similar to that described above also arises, due to leakage current Co, Cs from a line extending from the electronic circuit E toward the control switch S to ground 2.

SUMMARY OF THE INVENTION

The present invention has been accomplished with the above circumstance in view, and it is an object of the present invention to ensure that even when the drive circuit system for the power window is wet with water due to the entering of water or the condensation of water, the opening and closing of the power window can be performed without hindrance.

To achieve the above object, there is provided a drive circuit system for a power window, for driving a motor for opening and closing a power window, comprising an opening relay for connecting the motor to a power source in order to drive the motor in a window opening direction, and a closing relay for connecting the motor to the power source in order to drive the motor in a window closing direction. A control switch connects one end of a coil of the opening relay and one end of a coil of the closing relay to a ground by operation of the control switch to a neutral position thereof, connects the one end of the coil of the opening relay to the power source and the one end of the coil of the closing relay to ground by operation of said control switch to an open position thereof, and connects the one end of the coil of the closing relay to the power source and the one end of the coil of the opening relay to ground by operation of the control switch to a closed position thereof. An electronic circuit which has been treated with a water-proofing, controls the supply of current to the opening relay and the closing relay, wherein the electronic circuit comprises an opening drive circuit which includes two transistors connected in series between the power source and ground, a point between the transistors being connected to the other end of the coil of the opening relay, and a closing drive circuit which includes two transistors connected in series between the power source and ground, a point between the transistors being connected to the other end of the coil of the closing relay.

With the above arrangement, when both of the control switch and the electronic circuit are in their neutral positions, the coils of the opening relay and the closing relay are connected at opposite ends thereof to ground, through the control switch and the electronic circuit. Therefore, the opening relay and the closing relay are brought into opened states, so that the motor is not driven. At this time, even if leakage current flows from the power source to the one or the other end of the coil due to the wetting, the leakage current flows to ground through the control switch or the electronic circuit without flowing through the coil. Therefore, the relay cannot be closed, thus preventing the mis-operation of the power window.

When the control switch is in its open position or its closed position, the coil of the opening relay or the closing relay is connected at one end thereof to the power source through the control switch and at the other end to ground through the electronic circuit. Therefore, the opening relay or the closing relay is brought into its closed state, so that the motor is driven in a window opening direction or in a window closing direction. At this time, even if leakage current flows from the power source to the other end of the coil due to the wetting, the leakage current flows to ground through the electronic circuit without flowing through the coil. Even if leakage current flows from one end of the coil to ground, the leakage current is caught by the current flowing from the power source. Therefore, the relay can be reliably closed to open and close the power window.

When the electronic circuit is in its open position or in its closed position, the coil of the opening relay or the closing relay is connected at the other end to the power source through the electronic circuit and at the one end to ground through the control switch. Therefore, the opening relay or the closing relay is brought into its closed state, so that the motor is driven in the window opening direction or in the window closing direction. At this time, even if leakage current flows from the power source to one end of the coil due to the wetting, the leakage current flows to ground through the control switch without flowing through the coil. In addition, even if leakage current flows from the other end of the coil to ground, the leakage current is caught by the current flowing from the power source. Therefore, the relay can be reliably closed to open and close the power window.

Since the electronic circuit is subjected to water-proofing treatment to prevent the mis-operation of the transistors, the above-described operation cannot be influenced by the water-wetting of the electronic circuit.

Further, there is provided a drive circuit system for a power window, for driving a motor for opening and closing a power window, comprising an opening relay for connecting the motor to a power source in order to drive the motor in a window opening direction, and a closing relay for connecting the motor to the power source in order to drive the motor in a window closing direction. A control switch connects one end of a coil of the opening relay and one end of a coil of the closing relay to ground by operation of the control switch to a neutral position thereof, connects the one end of the coil of the opening relay to the power source and the one end of the coil of the closing relay to ground by operation of the control switch to an open position thereof, and connects the one end of the coil of the closing relay to the power source and the one end of the coil of the opening relay to ground by operation of the control switch to a closed position thereof. An electronic circuit controls the supply of current to the opening relay and the closing relay, wherein the electronic circuit comprises an opening drive circuit which includes two transistors connected in series between the power source and ground, a point between the transistors being connected to the other end of the coil of the opening relay, a closing drive circuit which includes two transistors connected in series between the power source and ground, a point between the transistors being connected to the other end of the coil of the closing relay, and a water-wetting sensor which is operated upon the occurrence of wetting, to turn OFF the power source-side transistors of the opening drive circuit and the closing drive circuit and to turn ON ground-side transistors.

With the above arrangement, when both of the control switch and the electronic circuit are in their neutral positions, the coils of the opening relay and the closing relay are connected at opposite ends thereof to ground through the control switch and the electronic circuit. Therefore, the opening relay and the closing relay are brought into opened states, so that the motor is not driven. When the control switch is in its open position or its closed position, the coil of the opening relay or the closing relay is connected at one end thereof to the power source through the control switch and at the other end to ground through the electronic circuit. Therefore, the opening relay or the closing relay is brought into its closed state, so that the motor is driven in a window opening direction or in a window closing direction. When the electronic circuit is in its open position or in its closed position, the coil of the opening relay or the closing relay is connected at the other end to the power source through the electronic circuit and at one end thereof to ground through the control switch. Therefore, the opening relay or the closing relay is brought into its closed state, so that the motor is driven in the window opening direction or in the window closing direction.

When the electronic circuit is wetted by water, the water-wetting sensor is operated to connect the other end of the coil to ground. At this time, when the control switch is in its neutral position, even if leakage current flows from the power source to the one or other end of the coil, the leakage current flows to ground through the control switch or the electronic circuit without flowing through the coil. Therefore, the relay cannot be closed, thereby preventing the mis-operation of the power window. When the control switch is in its open position or in its closed position, and the coil is connected at one end thereof to the power source and at the other end to ground, even if leakage current flows from the power source to the other end of the coil, the leakage current flows to ground through the electronic circuit without flowing through the coil. In addition, even if leakage current flows from one end of the coil to ground, the leakage current is caught by the current flowing from the power source. Therefore, the relay can be reliably closed to open and close the power window.

BRIEF DESCRIPTION OF THE DRAWINGS

The mode for carrying out the present invention will now be described by way of an embodiment shown in the accompanying drawings.

DETAILED DESCRIPTION OF THE PREFERRED EMBODIMENT

Figure 1:
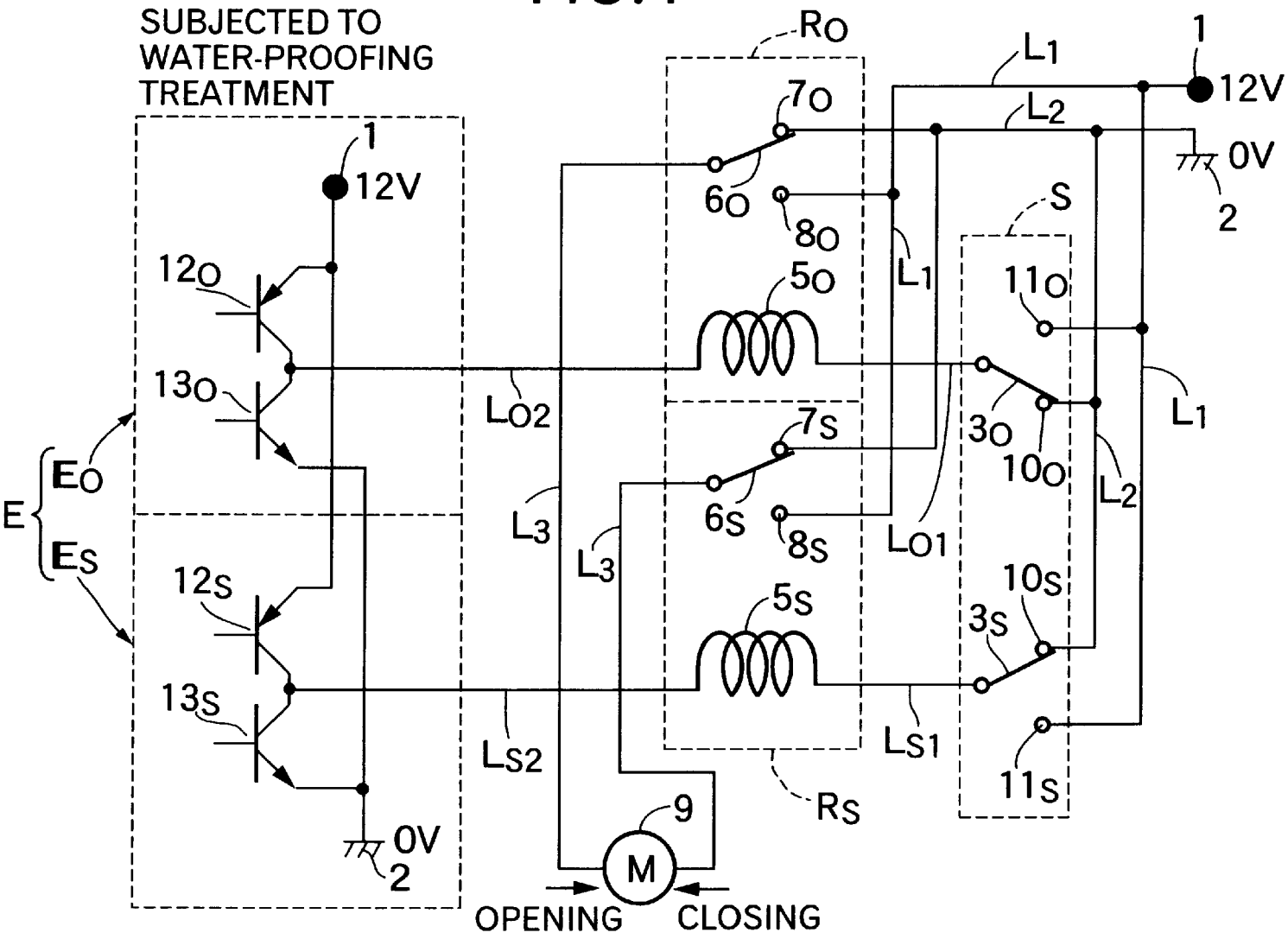
FIG. 1 is a schematic diagram of a drive circuit for a power window according to a first embodiment of the present invention.

As shown in FIG. 1, a coil 5*o* of an opening relay Ro in the drive circuit according to the first embodiment, is capable of being connected at one end thereof to a power source 1 and ground 2 through a control switch S and at the other end to the power source 1 and ground 2 through an opening drive circuit Eo. Similar, a coil 5*s* of a closing relay Rs, is capable of being connected at one end thereof to the power source 1 and ground 2 through the control switch S and at the other end to the power source 1 and ground 2 through a closing drive circuit Es.

The control switch S operated by an occupant other than a driver, includes an opening contact 3*o* and a closing contact 3*s*. When the control switch S is in its neutral position, the opening contact 3*o* and the closing contact 3*s* are connected to OFF terminals 10*o* and 10*s*, respectively. When the control switch S is operated to an open position, the opening contact 3*o* is connected to an ON terminal 11*o* with the closing contact 3*s* remaining connected to the OFF terminal 10*s*. As a result, a line $Lo_1$ at the one end of the coil 5*o* which had been connected to ground 2, is connected to the power source 1. When the control switch S is operated to a closed position, the closing contact 3*s* is connected to an ON terminal 11*s* with the opening contact 3*o* remaining connected to the OFF terminal 10*o*. As a result, a line $Ls_1$ at the one end of the coil 5*s* which had been connected to ground 2, is connected to the power source 1.

An electronic circuit E which has been subjected to a water-proofing treatment, is mounted on a driver's seat and operated by a switch (not shown) operated by the driver. The opening drive circuit Eo comprises a push/pull circuit including a power source-side transistor 12*o* and a ground-side transistor 13*o*, which are connected in series between the power source 1 and ground 2. A point between the power source-side transistor 12*o* and the ground-side transistor 13*o* is connected to a line $Lo_2$ at the other end of the coil 5*o* of the opening relay Ro. The closing drive circuit Es comprises a push/pull circuit including a power source-side transistor 12*s* and ground-side transistor 13*s* connected in series, which are connected in series between the power source 1 and ground 2. A point between the power source-side transistor 12*s* and the ground-side transistor 13*s* is connected to a line $Ls_2$ at the other end of the coil 5*s* of the closing relay Rs.

When the switch (not shown) mounted on the driver's seat is in its neutral position, the opening drive circuit Eo and the closing drive circuit Es are in states in which the power source-side transistors 12*o* and 12*s* have been turned OFF and the ground-side transistors 13*o* and 13*s* have been turned ON. Therefore, both of the lines $Lo_2$ and $Ls_2$ at the other ends of the coils 5*o* and 5*s* of the opening relay Ro and the closing relay Rs, are connected to ground 2. When the switch is operated to its open position, the power source-side transistor 12*o* of the opening drive circuit Eo is turned ON, and the ground-side transistor 13*o* is turned OFF. Therefore, the line $Lo_2$ at the other end of the coil 5*o* of the opening relay Ro, is connected to the power source 1. When the switch is operated to its closed position, the power source-side transistor 12*s* of the closing drive circuit Es, is turned ON, and the ground-side transistor 13*s* is turned OFF. Therefore, the line $Ls_2$ at the other end of the coil 5*s* of the closing relay Rs is connected to the power source 1.

The operation of the first embodiment of the present invention having the above-described arrangement will be described below.

When both of the control switch S operated by an occupant and the switch (not shown) operated by the driver are in their neutral positions, all of the lines $Lo_1$, $Lo_2$, $Ls_1$ and $Ls_2$ at the opposite ends of the coils 5*o* and 5*s* of the opening relay Ro and the closing relay Rs, are connected to ground 2 and hence, the motor 9 is not driven. When the control switch S is operated to its open position from this state, the opening contact 3*o* is connected to the ON terminal 11*o* with the closing contact 3*s* remaining connected to the OFF terminal 10*s*, and the ground-side transistor 13*o* of the opening drive circuit Eo, is in its ON state. Therefore, electric current flows across the coil 5*o* from the side of the line $Lo_1$ toward the line $Lo_2$ (i.e., in a leftward direction in FIG. 1) to close the opening relay Ro, and the motor 9 is driven in a window-opening direction to open the power window. When the control switch S is operated to its close position, the closing contact 3*s* is connected to the ON terminal 11*s* with the opening contact 3*o* remaining connected to the OFF terminal 10*o*, and the ground-side transistor 13*s* of the closing drive circuit Es is in its ON state. Therefore, electric current flows across the coil 5*s* from the side of the line $Ls_1$ toward the line $Ls_2$ (i.e., in the leftward direction in FIG. 1) to close the closing relay Rs, and the motor 9 is driven in a window-closing direction to close the power window.

On the other hand, when the switch operated by the driver is brought into its open position, the power source-side transistor 12*o* of the opening drive circuit Eo is turned ON, while the ground-side transistor 13*o* is turned OFF, and the opening contact 3*o* of the control switch S has been connected to the OFF terminal 10*o*. Therefore, electric current flows across the coil 5*o* from the side of the line $Lo_2$ toward the line $Lo_1$ (in a rightward direction in FIG. 1) to close the opening relay Ro, and the motor 9 is driven in the window-opening direction to open the power window. When the switch operated by the driver is brought into its closed position, the power source-side transistor 12*s* of the closing drive circuit Es is turned ON, while the ground-side transistor 13*s* is turned OFF, and the closing contact 3*s* of the control switch S is connected to the OFF terminal 10*s*. Therefore, electric current flows across the coil 5*s* from the side line $Ls_2$ toward the line $Ls_1$ (i.e., in the rightward direction in FIG. 1) to close the closing relay Rs, and the motor 9 is driven in the window closing direction to close the power window.

The operation provided upon occurrence of wetting due to the entering of water or the condensation of water will be described with respect to the following cases: (1) when the power window is not operated, (2) when the power window is operated by the control switch S, and (3) when the power window is operated by the electronic circuit E. The operation of the circuit in the window opening direction and the operation of the circuit in the window closing direction are substantially the same as each other and hence, one of the circuits (the circuit in the window opening direction) will be described below.

Figure 2:
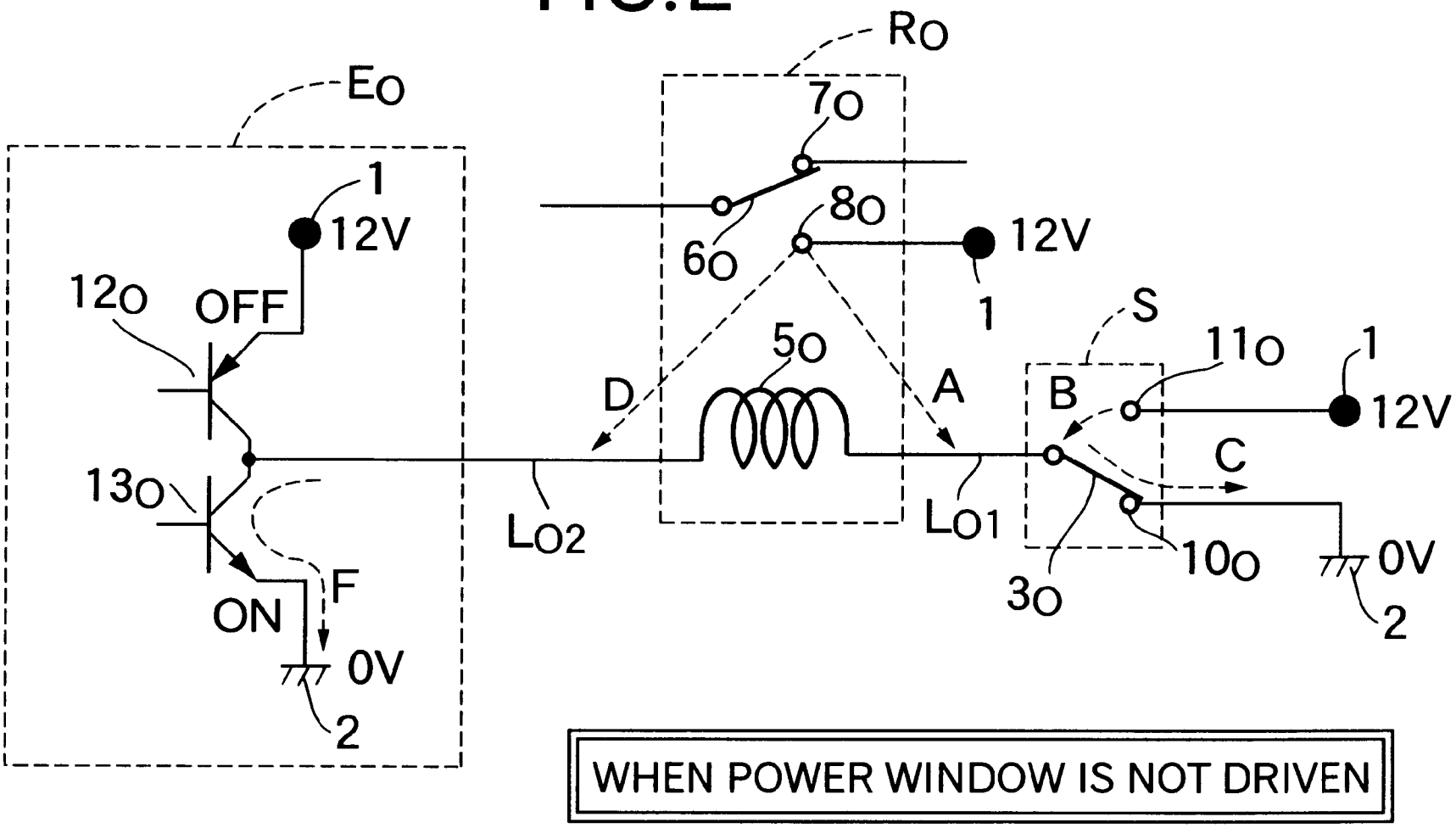
FIG. 2 is a schematic diagram for explaining the operation when the power window is not operated.

As shown in FIG. 2, when the power window is not operated, the line $Lo_1$ at one end of the coil 5*o* is connected to ground 2 through the control switch S, and the line $Lo_2$ at the other end of the coil 5*o* is also connected to ground 2 through the ground-side transistor 13*o* of the opening drive circuit Eo. In this state, if wetting occurs due to the entering of water or the condensation of water, leakage currents A and B flow from an ON terminal 8*o* of the opening relay Ro to which the voltage of the power source 1 is being applied, or from the ON terminal 11*o* of the operating switch S to which the voltage of the power source 1 is being applied, to the line $Lo_1$ at one end of the coil 5*o*. However, the leakage currents A and B flow to ground 2 along a path having a smaller resistance as shown by a broken line arrow C in FIG. 2, without flowing toward the coil 5*o* having a larger resistance and hence, the coil 5*o* cannot be excited to close the opening relay Ro.

Even if leakage current D flows from the ON terminal 8*o* of the opening relay Ro to which the voltage of the power source 1 is being applied, to the line $Lo_2$ at the other end of the coil 5*o* due to wetting, the leakage current D flows to ground 2 through the ground-side transistor 13*o* having a smaller resistance as shown by a broken line arrow F in FIG. 2, without flowing toward the coil 5*o* having the larger resistance. Therefore, the coil 5*o* cannot be excited to close the opening relay Ro. As a result, the motor 9 is prevented from being mis-operated in the window opening direction or in the window closing direction. Even upon the entering of water or the condensation of water, the power source-side transistor 12*o* is reliably maintained in its OFF state, and the ground-side transistor 13*o* is reliably maintained in its ON state, because the electronic circuit E has been subjected to the water-proofing treatment.

Figure 3:
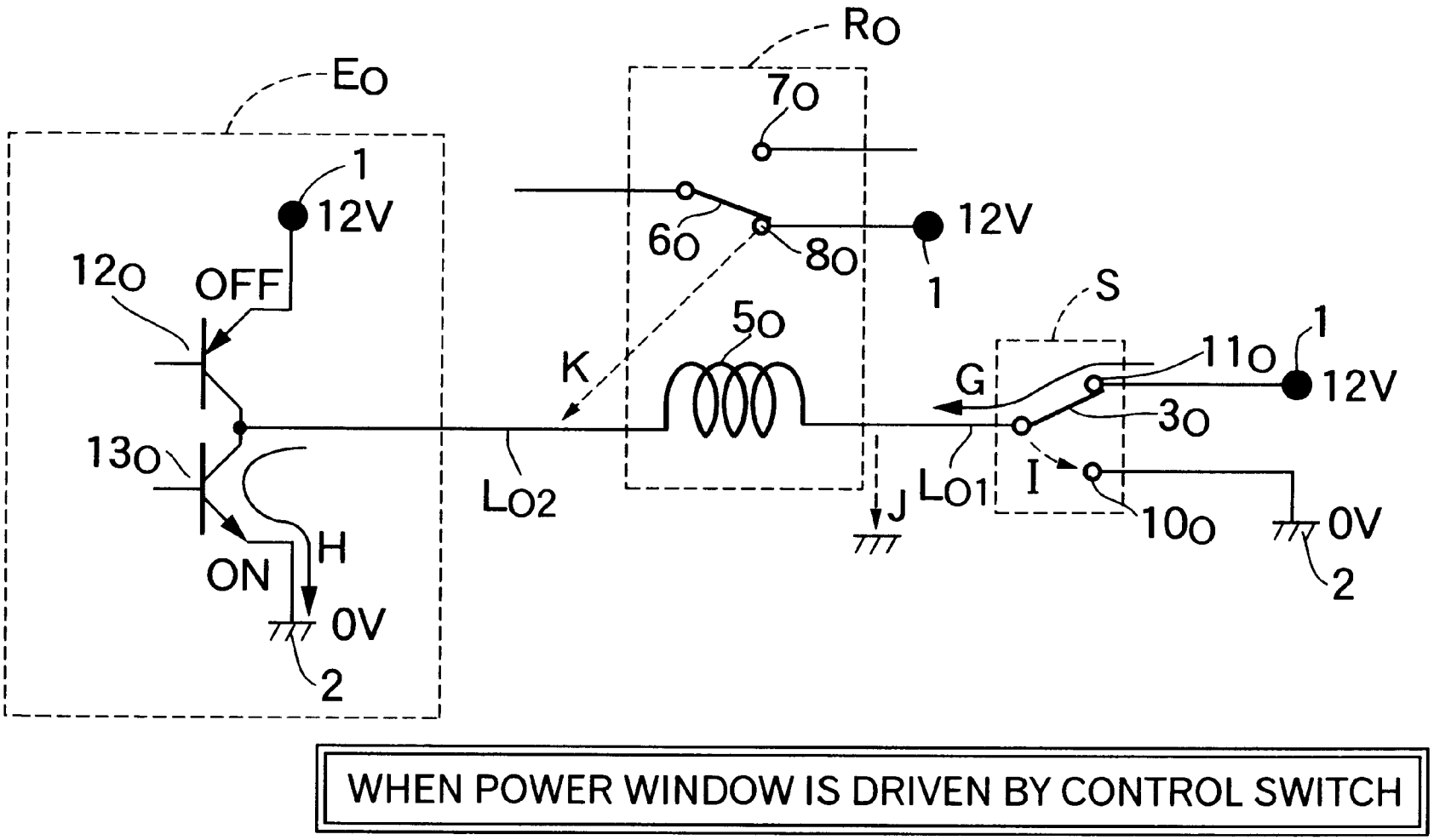
FIG. 3 is a schematic diagram for explaining the operation when the power window is operated by a control switch.

As shown in FIG. 3, when the power window is opened by the control switch S, electric current flows in a path of the power source 1 to the control switch S to the line $Lo_1$ to the coil 5*o* to the line $Lo_2$ to the ground-side transistor 13*o* of the opening drive circuit Eo K ground 2 (see solid line arrows G and H), thereby exciting the coil 5*o* to close the opening relay Ro, so that the motor 9 is driven in the window opening direction. At this time, even if leakage current I, J flows from the line $Lo_1$ to ground 2 due to wetting, the potential of the line $Lo_1$ connected to the power source 1, cannot be dropped, because the leakage current I, J is very weak. In addition, even if leakage current K flows from the ON contact 8*o* of the opening relay Ro to the line $Lo_2$ due to wetting, the potential of the line $Lo_2$ connected to ground 2 cannot be raised, because the leakage current K is very weak. As a result, the line $Lo_1$ is maintained at a higher potential, while the line $Lo_2$ is maintained at a lower potential, and the motor 9 is driven in the window opening direction without hindrance.

Figure 4:
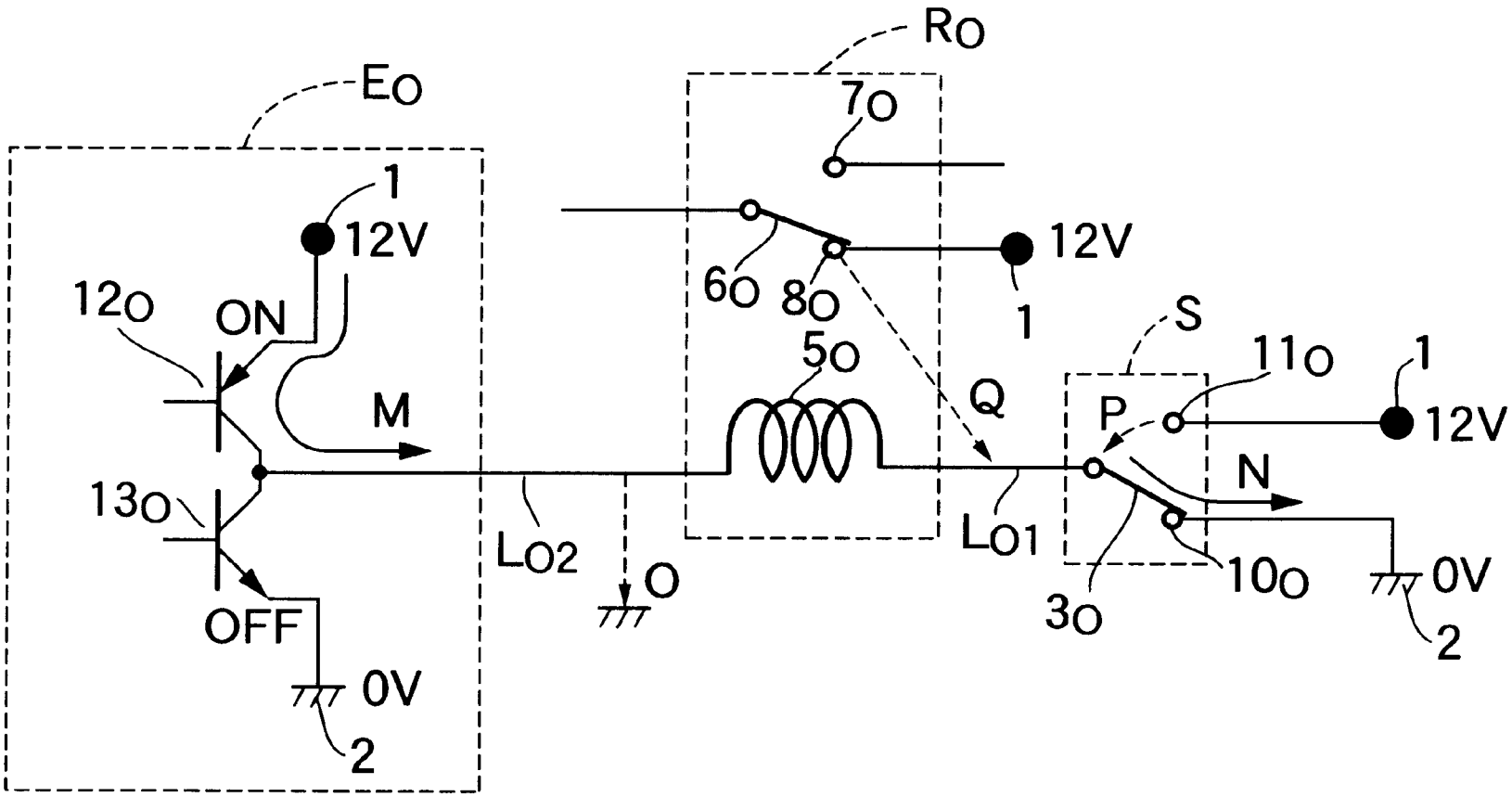
FIG. 4 is a schematic diagram for explaining the operation when the power window is operated by an electronic circuit.

As shown in FIG. 4, when the power window is opened by the electronic circuit E, electric current flows in a path of the power source 1 to the power source-side transistor 12*o* of the opening drive circuit Eo to the line $Lo_2$ to the coil 5*o* to the line $Lo_1$ to the control switch S to ground 2 (see solid line arrows M and N), thereby exciting the coil 5*o* to close the opening relay Ro, so that the motor 9 is driven in the window opening direction. At this time, even if leakage current O flows from the line $Lo_2$ to ground 2 due to wetting, the potential of the line $Lo_2$ connected to the power source 1 cannot be dropped, because the leakage current O is very weak. In addition, even if leakage current P, Q flows from the ON terminal 8*o* of the opening relay Ro or the ON terminal 11*o* of the control switch S to the line $Lo_1$ due to wetting, the potential of the line $Lo_1$ connected to ground 2 cannot be raised, because the leakage current P, Q is very weak. As a result, the line $Lo_2$ is maintained at a higher potential, while the line $Lo_1$ is maintained at a lower potential, and the motor 9 is driven in the window opening direction without hindrance.

A second embodiment of the present invention will now be described with reference to FIGS. 5 and 6.

Figure 5:
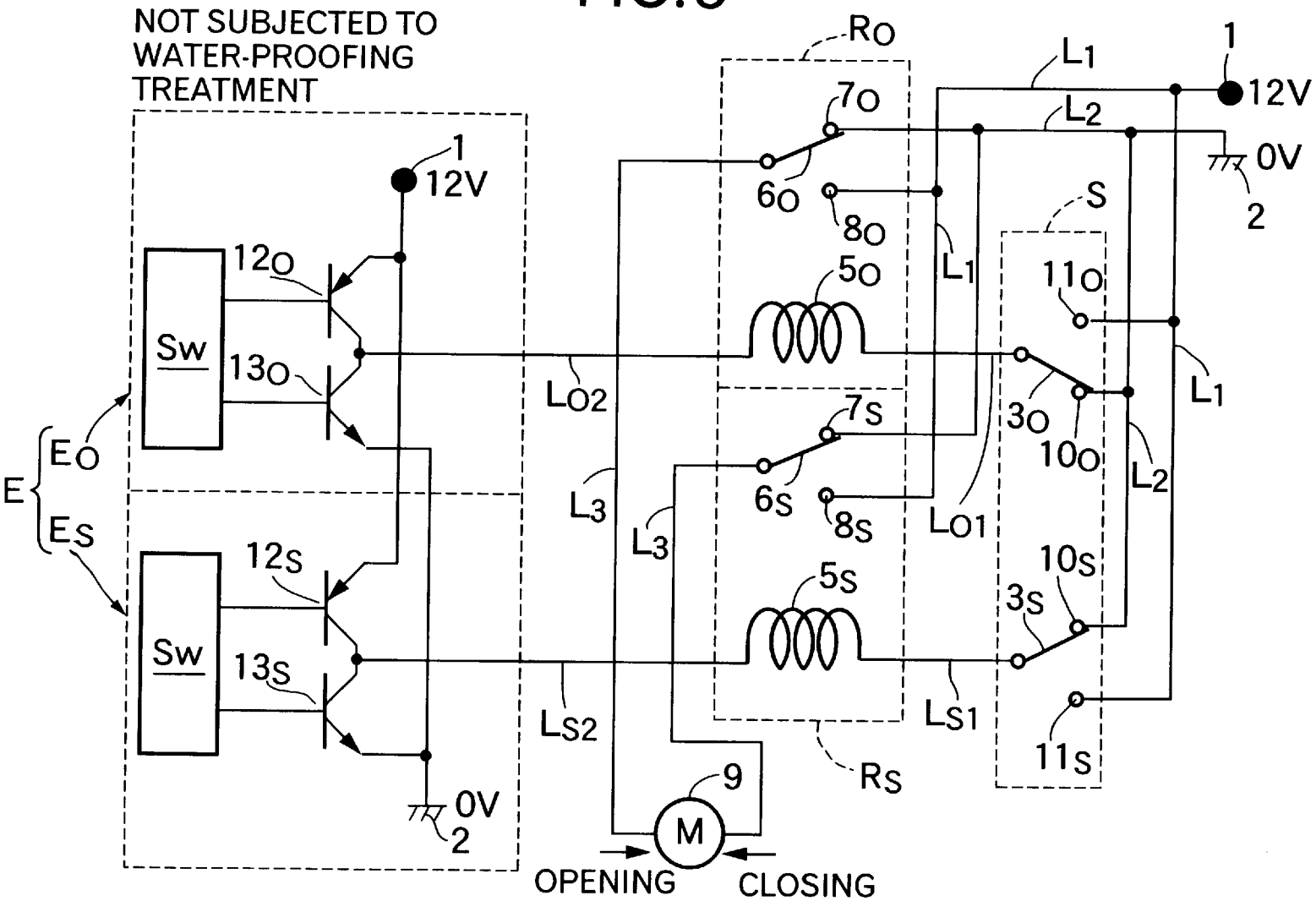
FIG. 5 is a schematic diagram showing a drive circuit for a power window according to a second embodiment of the present invention.
Figure 6:
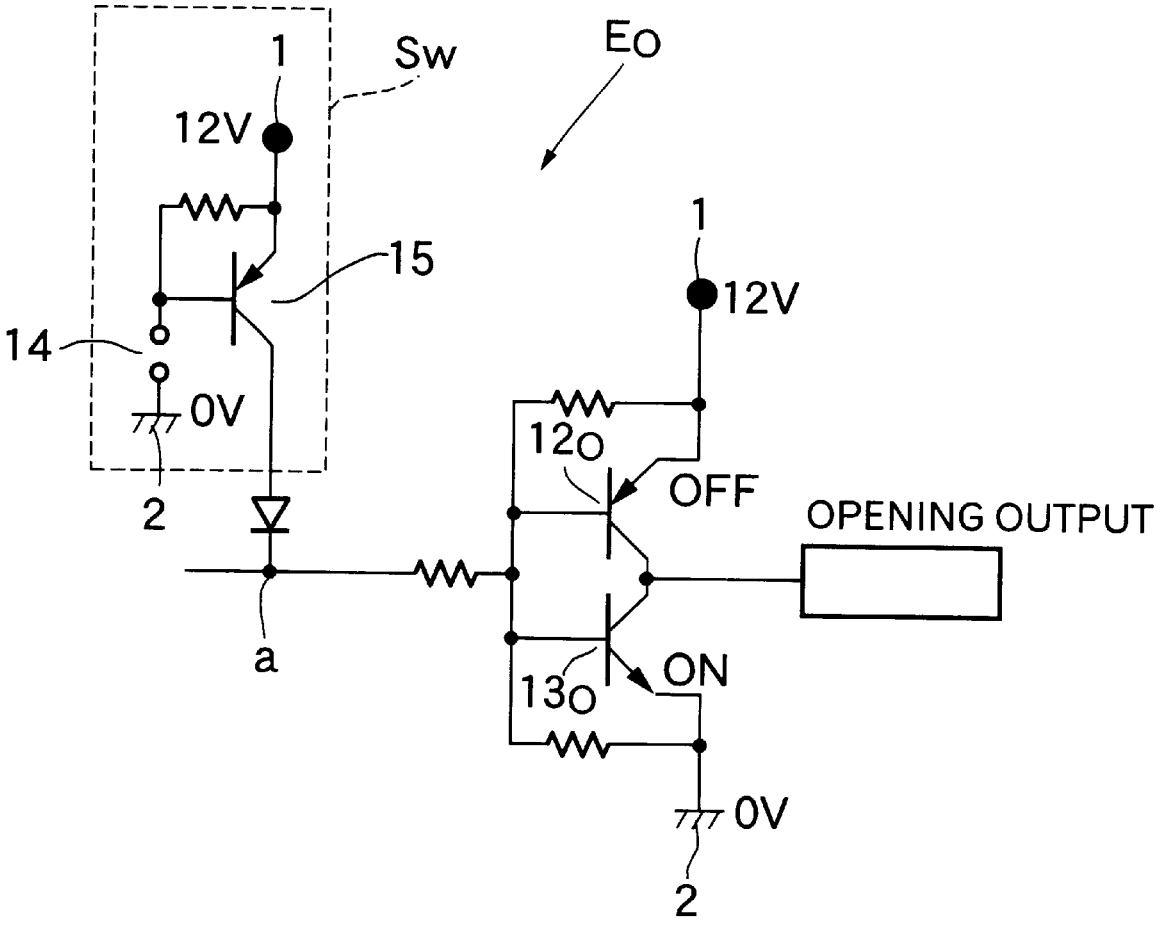
FIG. 6 is a schematic circuit diagram of an opening drive circuit.
Figure 7:
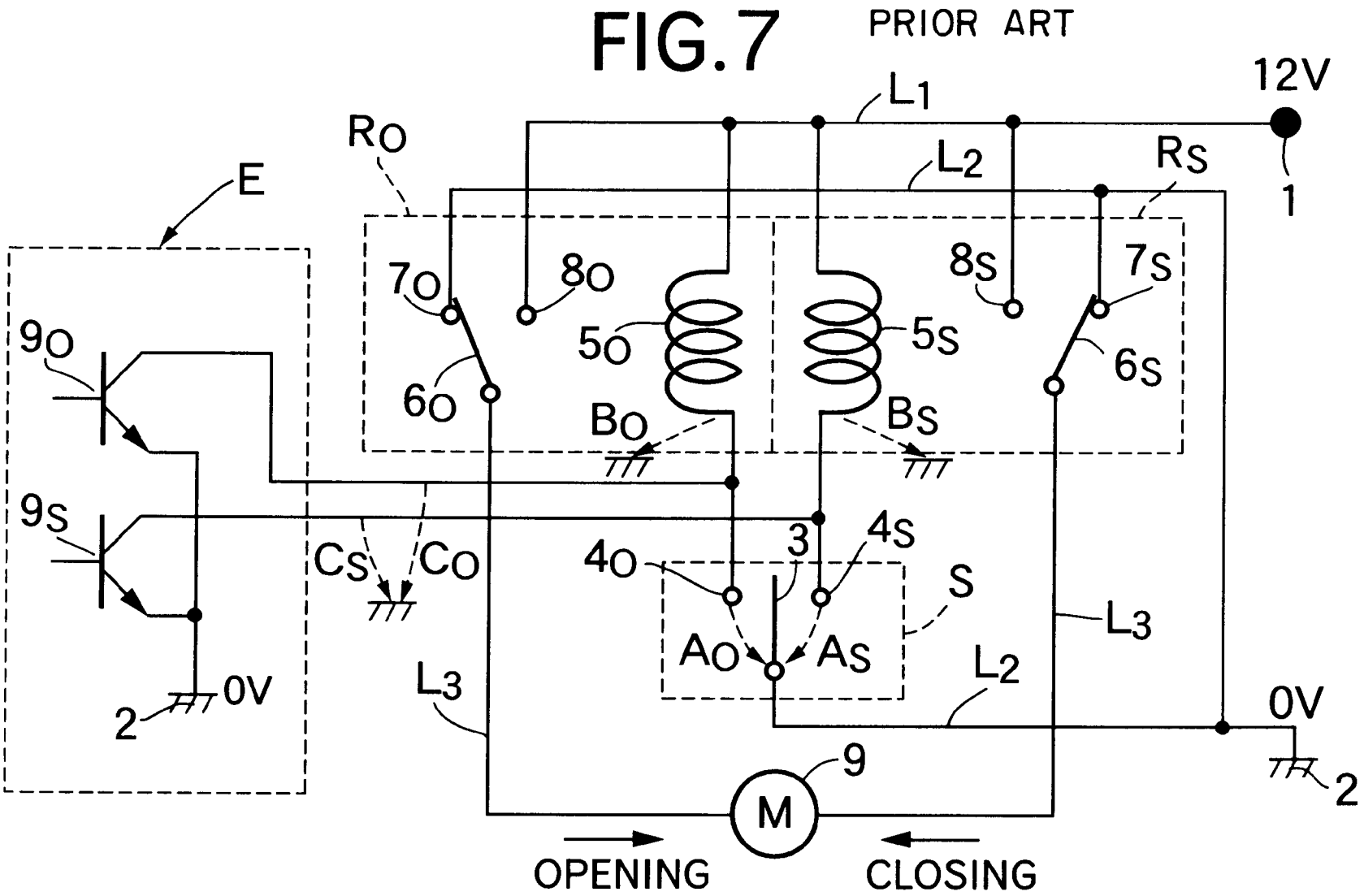
FIG. 7 is a schematic diagram showing a prior art drive circuit system for a power window.

As can be seen from the comparison of FIGS. 1 and 5 with each other, the power window drive circuit system according to the second embodiment is different from that according to the first embodiment in that the electronic circuit E is not subjected to the water-proofing treatment and in that the opening drive circuit Eo and the closing drive circuit Es have water-wetting sensors Sw, Sw, respectively. The opening drive circuit Eo and the closing drive circuit Es are substantially the same as each other and hence, the opening drive circuit Eo will be described with reference to FIG. 6.

The opening drive circuit Eo is designed so that when a point a is at a higher potential, the power source-side transistor 12*o* is turned OFF, and the ground-side transistor 13*o* is turned ON, and when the point a is at a lower potential, the power source-side transistor 12*o* is turned ON, and the ground-side transistor 13*o* is turned OFF. However, when the potential of the point a is varied due to wetting, it is impossible to accurately control the turning-ON/OFF of the power source-side transistor 12*o* and the ground-side transistor 13*o*. The water-wetting sensor Sw includes a transistor 15 normally disconnected at its base to ground 2 by a very small gap 14. When the gap 14 conducts due to wetting, the transistor 15 is turned ON to bring the point a to the higher potential, whereby the power source-side transistor 12*o* is held in its OFF state, and at the same time, the ground-side transistor 13*o* is held in an ON state.

As a result, the state is the same as that shown in FIG. 3 in the first embodiment (in which the power window is driven by the control switch S). Therefore, even if wetting occurs, the power window cannot be freely opened and closed, but the power window can be opened and closed without hindrance by operating the control switch S.

As discussed above, according to the present invention, even if the drive circuit system for the power window is wet with water, it is possible to prevent the power window from being mis-operated, when the control switch or the electronic circuit is in its neutral position. In addition, the power window can be opened and closed without hindrance by operating the control switch or the electronic circuit to the open position or the closed position.

Further, even if the drive circuit system for the power window is wetted with water, it is possible to prevent the power window from being mis-operated, when the control switch or the electronic circuit is in its neutral position. In addition, the power window can be opened and closed without hindrance, by operating the control switch to the open position or the closed position.

Although the embodiments of the present invention have been described in detail, it will be understood that the present invention is not limited to the above-described embodiments, and various modifications may be made without departing from the subject matter of the present invention.

It is claimed:

1. A drive circuit system for a power window, for driving a motor to open and close a power window, said drive circuit comprising:

an opening relay connecting said motor to a power source, to drive said motor in a window opening direction, a closing relay connecting said motor to said power source, to drive said motor in a window closing direction, a control switch connecting one end of a coil of said opening relay and one end of a coil of said closing relay to ground by operation of said control switch to a neutral position thereof, connecting the one end of the coil of said opening relay to said power source and the one end of the said coil of said closing relay to ground, by operation of said control switch to an open position thereof, and connecting the one end of the coil of said closing relay to said power source and the one end of the coil of said opening relay to ground, by operation of said control switch to a closed position thereof, and a water-proofed electronic circuit controlling the supply of current to said opening relay and said closing relay, wherein said electronic circuit comprises:

an opening drive circuit having a first transistor connected in series to selectively supply power from said power source to a first node and a second transistor connected to selectively connect said first node to ground, said first node between said first and second transistors of said opening drive circuit being connected to the other end of the coil of said opening relay, and a closing drive circuit having a first transistor connected Lo selectively supply power from said power source to a second node and a second transistor connected to selectively connect said second node to ground, said second node between said first and second transistors of said closing drive circuit being connected to the other end of the coil of said closing relay.

2. A drive circuit system for a power window, for driving a motor to open and close a power window, said drive circuit comprising:

an opening relay connecting said motor to a power source, to drive said motor in a window opening direction, a closing relay connecting said motor to said power source, to drive said motor in a window closing direction, a control switch connecting one end of a coil of said opening relay and one end of a coil of said closing relay to ground by operation of said control switch to a neutral position thereof, connecting the one end of the coil of said opening relay, to said power source and the one end of the coil of said closing relay, to ground by operation of said control switch to an open position thereof, and connecting the one end of the coil of said closing relay, to said power source and the one end of the coil of said opening relay, to ground by operation of said control switch to a closed position thereof, and an electronic circuit controlling the supply of current to said opening relay and said closing relay, wherein said electronic circuit comprises:

an opening drive circuit having a first transistor connected to selectively supply power from said power source to a first node and a second transistor connected to selectively connect said first node to ground, said first node between said first and second transistors of said opening drive circuit being connected to the other end of the coil of said opening relay, and a closing drive circuit having a first transistor connected to selectively supply power from said power source to a second node and a second transistor connected to selectively connect said second node to ground, said second node between said first and second transistors of said closing drive circuit being connected to the other end of the coil of said closing relay, and a water-wetting sensor sensing wetting in said drive circuit and, when wetting in said drive circuit is sensed, turning OFF said first transistors of said opening drive circuit and said closing drive circuit and turning ON said second transistors of said opening drive circuit and said closing drive circuit.

* * * * *